US005547610A

United States Patent [19]

Mortensen

[11] Patent Number: 5,547,610

[45] Date of Patent: Aug. 20, 1996

[54] CONDUCTIVE POLYMERIC ADHESIVE FOR FLOORING CONTAINING SILVER-COATED NON-CONDUCTIVE FIBER CORES

[75] Inventor: Kelly J. Mortensen, Conyngham, Pa.

[73] Assignee: Forbo Industries, Inc., Hazelton, Pa.

[21] Appl. No.: 237,026

[22] Filed: May 3, 1994

[51] Int. Cl.[6] ..... H01B 1/16; D02G 3/00

[52] U.S. Cl. ..... 252/514; 264/104; 524/457; 428/378; 428/389

[58] Field of Search ..... 252/512, 514; 264/104; 524/457; 428/378, 389

[56] References Cited

U.S. PATENT DOCUMENTS

| | | | |
|---|---|---|---|
| 3,877,965 | 4/1975 | Broadbent et al. | 427/304 |
| 4,042,737 | 8/1977 | Forsgren et al. | 428/96 |
| 4,247,596 | 1/1981 | Yee | 428/380 |
| 4,534,886 | 8/1985 | Kraus et al. | 252/502 |
| 4,566,990 | 1/1986 | Lim et al. | 252/503 |
| 4,729,809 | 3/1988 | Dery et al. | 156/306.6 |
| 4,752,415 | 6/1988 | Iwaskow et al. | 252/511 |
| 4,882,089 | 11/1989 | Iwaskow et al. | 428/242 |
| 5,075,038 | 12/1991 | Cole et al. | 252/514 |
| 5,229,037 | 7/1993 | Nakano et al. | 252/512 |
| 5,262,229 | 11/1993 | Lampert et al. | 428/220 |
| 5,286,417 | 2/1994 | Mahmoud et al. | 252/518 |
| 5,378,407 | 1/1995 | Chandler et al. | 252/518 |

OTHER PUBLICATIONS

S. M. Darwish, A. Niazi, A. Ghania, M. E. Kassem; Improving the Electrical Properties of Structural Epoxy Resin Adhesives; Jan. 1991.

Int. J. Adhesion and Adhesives; International News, p. 7; Electrically Conductive Epoxy, Jan. 1982.

Adhesive Abstracts, May 1988, p. 11; EMI/RFI Conductive Adhesives; EMI/RFI Conductive Caulking and Adhesives.

Adhesives Abstracts, May 1989, p. 9; TRA-Shield 2867; Conductive Silver Epoxy Coating.

Adhesives Abstracts, Sep. 1989, pp. 9–10; B-568 UV Curing Conductive Adhesive.

Adhesives Age, Apr. 1990, p. 8; Solvent Free Epoxy Series.

DIALOG FILE 399:CA Search; American Chemical Society; 113025206 CA: 113(4)25206M Journal Electroconductive Glue Line by Metalized Carrier 1989 no month available.

*Primary Examiner*—Paul Lieberman
*Assistant Examiner*—M. Kopec
*Attorney, Agent, or Firm*—R. Anthony Diehl; William H. Murray

[57] ABSTRACT

Compositions, methods of providing compositions, flooring assemblies incorporating compositions, and methods for discharging accumulated electrostatic charges utilizing compositions of conductive adhesive are provided. The compositions comprise a non-conductive adhesive in which a plurality of silver plated or coated conductive fibers are dispersed such that the conductive fibers form an electroconductive chain when applied to a substrate.

12 Claims, 3 Drawing Sheets

CONDUCTIVE POLYMERIC ADHESIVE FOR FLOORING CONTAINING SILVER-COATED NON-CONDUCTIVE FIBER CORES

FIELD OF INVENTION

This invention relates to a conductive adhesive composition for flooring and, in particular, to a conductive adhesive composition comprised of a non-conductive adhesive and conductive fibers.

BACKGROUND OF THE INVENTION

Electrostatic discharge is problematic in the manufacturing, assembling, and functioning of parts for various electrical and electronic equipment, particularly semiconductor devices. More specifically, burn damage to the parts produced or assembled may result from the discharge of accumulated electrostatic charges within a room. Further, electrostatic charging of a room may result in adherence of dust to room surfaces. Finally, electrostatic discharge may cause electrical and electronic equipment to malfunction. Thus, the surfaces, i. e., walls, ceilings, and floors, of rooms in which electrical and electronic parts are manufactured and in which electronic equipment is utilized ideally are electroconductive so that any electrostatic charges within the room can be leaked to prevent the charging of the room.

Because electrostatic charges may accumulate on the conductive flooring utilized in such rooms, it is desirable to provide a means for discharging the accumulated charges from the conductive flooring material. Conductive flooring adhesives, which provide electroconductivity between the flooring and a conductor, such as a ground strap or wire, are commonly used for this purpose. Generally, the conductive adhesives are either non-conductive adhesives containing carbon fibers or conductive epoxies.

Utilization of these conventional adhesives is problematic for a variety of reasons. The application of carbon fiber or carbon coated fiber containing conductive adhesives is a labor intensive process because use of these adhesives may require the application of a conductive primer. Additionally, the carbon or carbon coated fibers within the adhesive lose their conductivity over time, possibly due to the cracking or breaking of the fibers. For those adhesives in which conductive epoxies are used, on-site mixing of the components of the epoxy is required which is a labor intensive process.

SUMMARY OF THE INVENTION

The present invention provides compositions, methods of providing compositions, flooring assemblies incorporating compositions, and methods for discharging accumulated electrostatic charges utilizing compositions of conductive adhesive that are cost-effective, durable, and easily applied. Such compositions comprise a non-conductive adhesive and a plurality of conductive fibers dispersed within the non-conductive adhesive, the amount and dimensions of the conductive fibers such that the conductive fibers form an electroconductive chain when the composition is applied to a substrate. By adhering conductive flooring material to the composition of the present invention and establishing an electrical connection between the adhesive, the flooring material, and ground, electrical charges may be discharged from the conductive flooring material.

The conductive adhesive composition of the present invention comprises:

(a) a non-conductive adhesive; and (b) a plurality of conductive fibers dispersed within the non-conductive adhesive in an amount effective to form an unbroken electroconductive chain when the conductive adhesive composition is applied to a substrate, the non-conductive fibers comprising non-conductive fiber cores plated or coated with silver.

The invention further provides a method for providing a conductive adhesive composition comprising mixing into a non-conductive adhesive a plurality of conductive fibers in an amount effective to form an unbroken electroconductive chain when the conductive adhesive composition is applied to a substrate, the plurality of conductive fibers comprising non-conductive fiber cores plated or coated with silver.

Further, the invention provides an electrically conductive assembly for floors, comprising:

(a) a conductive adhesive composition comprising a plurality of conductive fibers dispersed within a non-conductive adhesive in an amount effective to form an electroconductive chain when the conductive adhesive composition is applied to a substrate, the plurality of conductive fibers comprising non-conductive fiber cores plated or coated with silver;

(b) a conductive flooring material adhered to and on the conductive adhesive composition; and (c) a conductor in electrical contact with the electroconductive chain of the conductive adhesive composition and the conductive flooring.

Finally, the present invention provides a method for discharging electrical charges from a conductive flooring material, comprising the steps of:

(a) applying a conductive adhesive composition to a substrate, the conductive adhesive composition comprising a plurality of conductive fibers dispersed within a non-conductive adhesive in an amount effective to form an unbroken electroconductive chain when the conductive adhesive composition is applied to a substrate, the plurality of conductive fibers comprising non-conductive fiber cores plated or coated with silver, each of the plurality of conductive fibers having a length of about 200 mils and a diameter of about 1.8 denier;

(b) adhering a conductive flooring material to and on the conductive adhesive; and (c) establishing an electrical connection among the fibers of the conductive adhesive, the conductive flooring material, and a ground.

DESCRIPTION OF THE PREFERRED EMBODIMENTS

Figure 2:
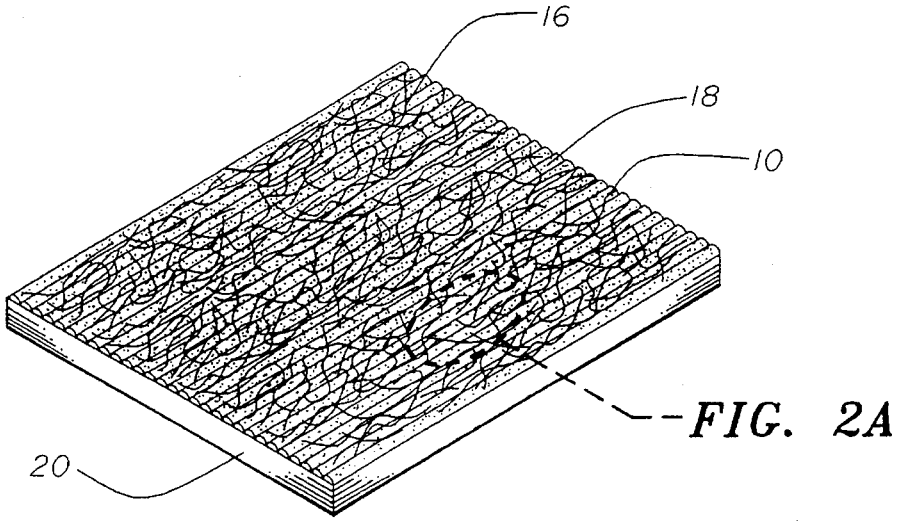
FIG. 2 is a perspective view of the conductive adhesive composition of the subject invention applied to a substrate.

Referring to FIG. 2, the conductive adhesive composition 16 of the present invention comprises flexible conductive fibers 10 dispersed within a non-conductive adhesive 18 to form an unbroken electroconductive chain, i.e., so that substantially every fiber 10 is in contact, directly or indirectly with substantially all fibers 10.

Figure 1:
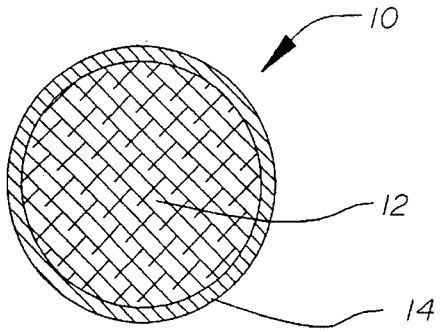
FIG. 1 is an enlarged cross-sectional view of a conductive fiber for use in the subject invention.

The conductive fiber 10 for use in the subject invention is shown in FIG. 1. The conductive fiber 10 comprises a non-conductive fiber core 12 and at least one layer of adherent conductive material 14 on the non-conductive fiber core 12. The non-conductive fiber core 12 may be formed from cellulose, cotton, silk, wool, nylon, polyester, acrylic, or the like. The non-conductive fiber core is preferably flexible. The type of material from which the non-conductive fiber core 12 is formed will be determined by the processing properties and the end-use desired for the conductive adhesive composition 16. It is preferred that the non-conductive fiber core 12 is formed from nylon because of the heat resistance properties and strength of nylon.

The non-conductive fiber core 12 is plated or coated with a conductive material 14 such as a metal, carbon, or the like. Plating of the non-conductive fiber core 12 can be accomplished by any of the conventional plating methods. Preferably, the non-conductive fiber core 12 is coated with silver. Suitable silver coated nylon fibers are available from Sauquoit Industries, Inc., Scranton, Pa. The silver coated nylon fibers are made, in general, by the procedures described in U.S. Pat. No. 3,877,965 which is incorporated herein, in its entirety, by reference.

The conductive adhesive composition 16 of the present invention is prepared by mixing the conductive fibers 10 with the non-conductive adhesive 18. The non-conductive adhesive 18 of the present invention may be any of the conventional flooring adhesives. Exemplary adhesives include, without limitation, acrylic adhesives, latex adhesives, and rubber adhesives such as styrene-butadiene rubber adhesive.

Typically the conventional conductive flooring that is utilized is such that an acrylic adhesive will be preferred for use as the non-conductive adhesive 18. Exemplary acrylic adhesives include, without limitation, 531™, a water-based acrylic adhesive, and 421™, a solvent-based acrylic adhesive, both of which are commercially available from Eurocol b.v.

Figure 2A:
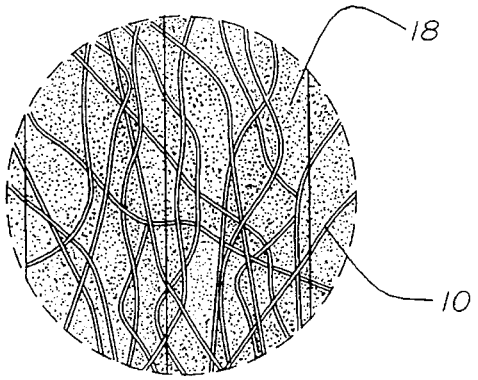
FIG. 2*a* is a magnified detailed plan view of the conductive adhesive composition of the subject invention applied to a substrate.

The amount of the conductive fibers 10 added to the non-conductive adhesive 18 must be carefully regulated. The addition of too great an amount of fiber may render the conductive adhesive composition 16 difficult to process and spread by trowel and may affect the composition's adhesive properties. If an insufficient amount of conductive fibers is added, the conductive properties of the conductive adhesive composition 16 will be affected in that the amount of the conductive fibers 10 will not permit the formation of an unbroken electroconductive chain so that each fiber in the composition is in contact with every other fiber in the composition as depicted in FIG. 2*a*. Preferably, an amount of about 58 grams of the conductive fibers 10 are added per gallon of the non-conductive adhesive 18.

The length of the conductive fibers 10 utilized is important also. As is shown in FIG. 2*a*, the conductive fibers 10 must touch to form a conductive chain. If the conductive fibers 10 are too short, they will not touch to form an unbroken conductive chain, as depicted in FIG. 2*a*, when the adhesive composition 16 of the present invention is spread onto a substrate 20. If the conductive fibers 10 are too long, they will curl so as not to form a contiguous chain. Additionally, fibers that are too long will be very difficult to trowel. Preferably, the conductive fibers 10 each have a length of about 200 mils.

The diameter of the conductive fibers 10 is not critical to the practice of the invention. However, smaller diameter fibers are preferred because they can provide adequate conductivity at a lower cost when compared with larger diameter fibers. The conductive fibers 10 preferably have a diameter of about 1.8 denier.

Figure 4:
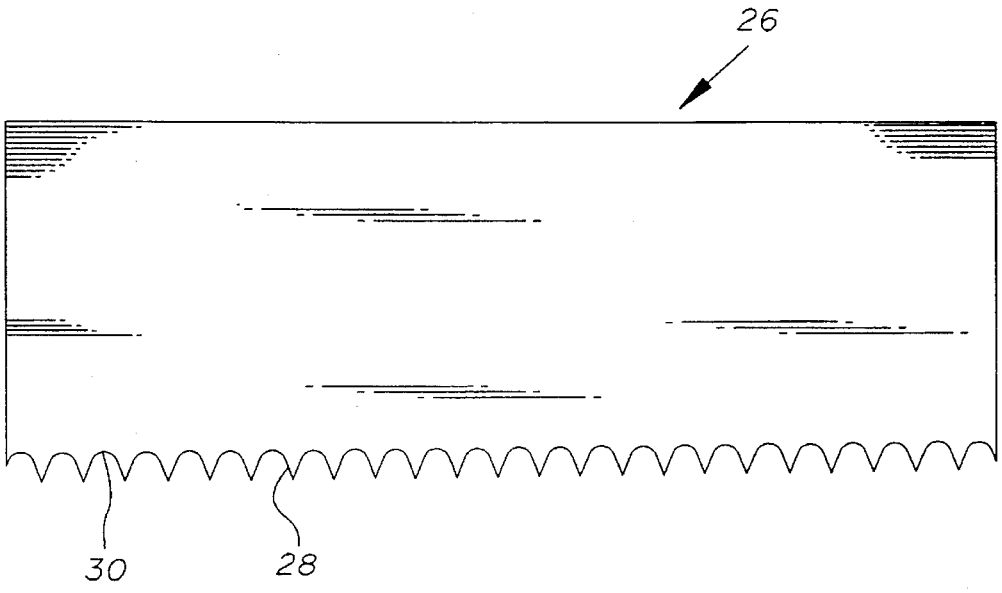
FIG. 4 is a plan view of the trowel utilized to apply the conductive adhesive composition of the present invention.
Figure 4A:
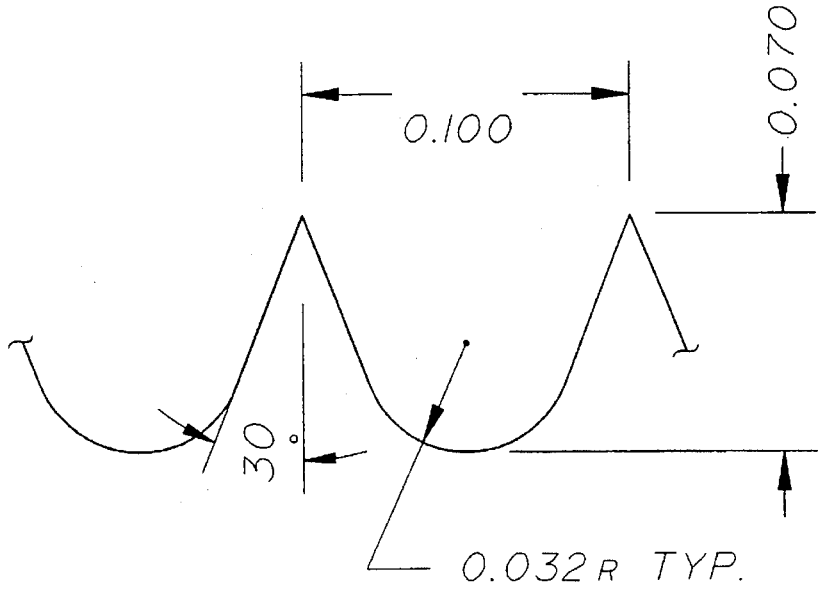
FIG. 4*a* is a magnified plan view of a trowel tooth illustrating the dimensions of the teeth of the trowel depicted in FIG. 4.

The conductive adhesive composition 16 of the present invention must be applied to the substrate 20 by use of the trowel 26, depicted in FIG. 4. The trowel 26 is generally planar and rectangular and has teeth 28 projecting from one edge thereof with spaces 30 therebetween. The trowel is designed so that the conductive adhesive composition 16 may be spread onto the substrate in parallel rows of a height determined by the configuration of the spaces 30. Further, the configuration of the teeth 28 and the spaces 30 are such that the parallel rows of the adhesive composition 16 are in sufficient proximity so that the conductive fibers 10 will overlap the parallel rows of the adhesive composition 16 so as to form an unbroken electroconductive chain. The spaces of the trowel are additionally configured to permit the conductive fibers 10 to flow through the spaces 30 as the conductive adhesive composition 16 is spread onto the substrate 20. This flow provides for the orientation of the conductive fibers 10 along the plane of the top surface of the substrate 20 in which trowel 26 moves.

Specifically, each of the teeth 28 ends in a point. Near the point, each tooth 28 has angled straight edges, the angle being small so that the sides of the rows of conductive adhesive composition 16 will be close together. The edge of trowel 26 intermediate each pair of the teeth is smoothly curved inward, without internal corners, to prevent bunching of conductive fibers 10 and so that each row of the conductive adhesive composition 16 has a convex upper surface. Trowel 26 may be formed from any conventional trowel material. Preferably trowel 26 is formed from steel.

Figure 3:
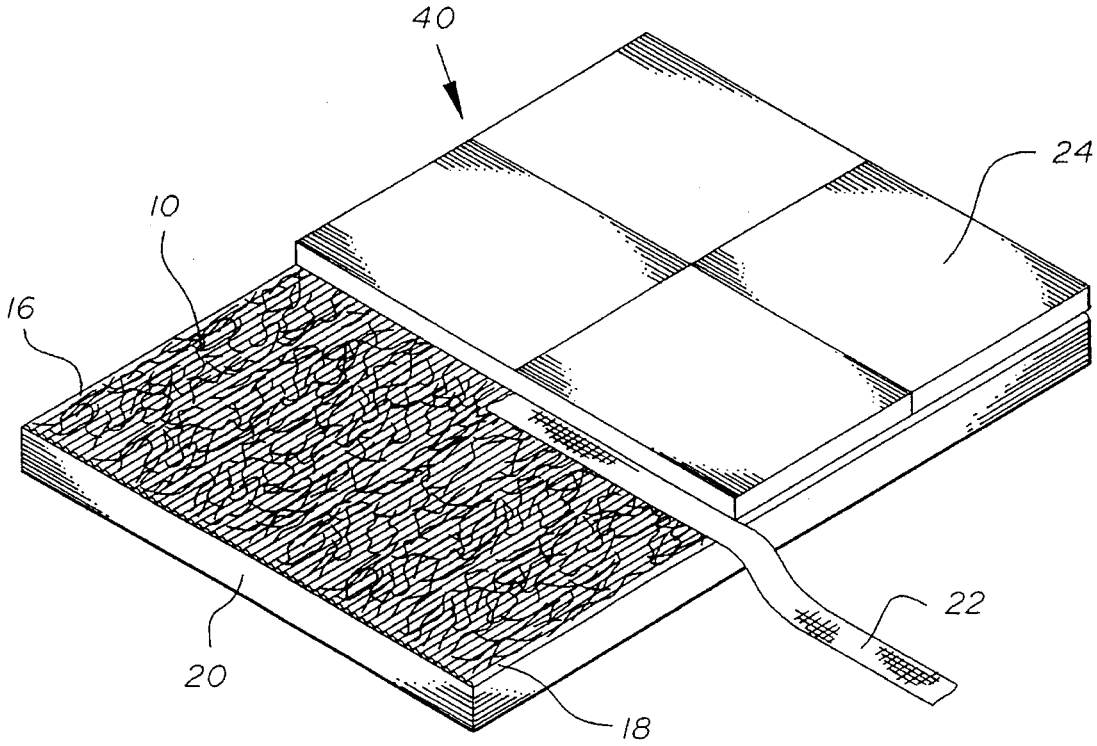
FIG. 3 is a perspective view of flooring tiles adhered to the conductive adhesive composition applied to a substrate.

FIG. 3 illustrates an electrically conductive assembly 40 for floors. In this assembly the conductive adhesive composition 16 is used to bind the conductive flooring material 24 to a substrate 20. Electrical continuity among the conductive adhesive 16, the conductive flooring material 24, and a ground may be provided by any conductor conventionally used for establishing such continuity. As depicted in FIG. 3, electrical continuity may be provided by a ground strap 22.

After troweling of the layer of the adhesive composition 16 onto the substrate 20, the ground strap 22 is placed on the adhesive composition 16. The conductive flooring material 24 is then applied on top of the adhesive composition 16 and the ground strap 22. The conductive flooring material 24 is preferably in the form of tiles, which may be, for example COLOREX™ tiles as available from Forbo Industries, Inc. or any commercially available conductive tiles. The ground strap 22 is placed on the conductive adhesive 16 so as to contact the conductive fibers 10 as well as the conductive flooring tiles 24 in order to establish an electrical flow path.

It is well known to provide electrical continuity between prior art conductive adhesives for flooring, conductive flooring tiles, and a ground by a variety of conductors. For example, metal plated ground straps, including copper ground straps, may be used as conductors by embedding the ground straps into a conductive adhesive underlying conductive flooring tiles and connecting the ground straps to a grounding means. However, conventional metal plated ground straps are difficult to handle and subsequent corrosion of the straps can interfere with the electrical continuity.

Silver coated nylon fabric ground straps 22 have been found to provide a less expensive, easier to handle alternative conductor. Further, as the silver corrodes, electrical conductivity is retained because silver corrosion does not create an insulating effect. In the present invention, therefore, silver coated nylon fabric ground straps are the preferred conductors for providing electrical continuity among the conductive fibers 10, the conductive adhesive composition 16, and the conductive flooring tiles 24 and a grounding means. In general, one three foot length of ground strap for every 500 square feet of flooring is sufficient.

It is thought that the conductive adhesive composition of the present invention and many of its advantages will be understood from the foregoing description. It will be apparent that various changes may be made without departing from the spirit or the scope of the invention or sacrificing all of its material advantages. The invention has been described herein for the purpose of illustration and it is not to be construed or limited thereby, but it is intended to cover all changes and modifications within the spirit and scope thereof.

What is claimed is:

1. A conductive adhesive composition, comprising:

(a) a non-conductive Polymeric adhesive; and (b) a plurality of conductive fibers dispersed within the non-conductive adhesive in an amount effective to form an unbroken electroconductive chain when the conductive adhesive composition is applied to a substrate, the conductive fibers comprising non-conductive fiber cores plated or coated with silver, wherein:

the non-conductive fiber cores are selected from the group consisting of nylon, polyester, acrylic, cellulose, cotton, silk, or wool.

2. The composition of claim 1, wherein the amount of conductive fibers is about 58 g. per gallon of the non-conductive adhesive.

3. The composition of claim 1, wherein each of the conductive fibers has a length of about 200 mils.

4. The composition of claim 1, wherein each of the conductive fibers has a diameter of about 1.8 denier.

5. The composition of claim 1, wherein the non-conductive adhesive is an acrylic adhesive.

6. The composition of claim 1, wherein the non-conductive adhesive is a latex adhesive.

7. The composition of claim 1, wherein the non-conductive adhesive is a rubber adhesive.

8. The composition of claim 1, wherein each of the conductive fibers has a length of about 200 mils and a diameter of about 1.8 denier and the amount of conductive fibers is about 58 g. per gallon of the non-conductive adhesive.

9. A method of providing a conductive adhesive composition, comprising the step of mixing into a non-conductive Polymeric adhesive a plurality of conductive fibers in an amount effective to form an unbroken electroconductive chain when the conductive adhesive composition is applied to a substrate, the plurality of conductive fibers comprising non-conductive fiber cores plated or coated with silver, wherein the non-conductive fiber cores are selected from the group consisting of nylon, polyester, acrylic,cellulose, cotton, silk, or wool.

10. The method of claim 9, wherein the amount of conductive fibers is about 58 g. per gallon of the non-conductive adhesive.

11. The method of claim 9, wherein each of the conductive fibers has a length of about 200 mils.

12. The method of claim 9, wherein each of the conductive fibers has a diameter of about 1.8 denier.

* * * * *